US009016214B2

(12) United States Patent
Zang et al.

(10) Patent No.: US 9,016,214 B2
(45) Date of Patent: Apr. 28, 2015

(54) SHELVING SYSTEM HAVING A SHELF WITH BIASING ELEMENTS TO RESIST INADVERTENT OR ACCIDENTAL DETACHMENT FROM A SUPPORT RAIL

(75) Inventors: Dathan G. Zang, Grand Haven, MI (US); Donald M. Farnquist, II, Muskegon, MI (US); Benjamin B. Edinger, Grand Haven, MI (US); William J. Parsons, Hamilton, MI (US)

(73) Assignee: Altria Group Distribution Company, Richmond, VA (US)

( * ) Notice: Subject to any disclaimer, the term of this patent is extended or adjusted under 35 U.S.C. 154(b) by 391 days.

(21) Appl. No.: 13/298,677

(22) Filed: Nov. 17, 2011

(65) Prior Publication Data

US 2013/0126454 A1 May 23, 2013

(51) Int. Cl.

| | |
|---|---|
| ***A47F 5/08*** | (2006.01) |
| ***A47F 5/10*** | (2006.01) |
| ***A47B 57/16*** | (2006.01) |
| ***A47B 96/02*** | (2006.01) |
| ***A47B 57/40*** | (2006.01) |

(52) U.S. Cl.

CPC ..... *A47F 5/103* (2013.01); *A47B 57/16* (2013.01); *A47B 96/027* (2013.01); *A47B 57/408* (2013.01)

(58) Field of Classification Search

CPC ..... A47B 57/06; A47B 57/10; A47B 57/16; A47B 57/34; A47B 57/42; A47B 57/52; A47B 57/406; A47B 57/408; A47B 96/027; A47B 96/028; A47F 5/103

USPC ..... 211/90.01, 90.04, 103, 187, 208; 108/147.11, 147.17, 152

See application file for complete search history.

(56) References Cited

U.S. PATENT DOCUMENTS

| | | | | | |
|---|---|---|---|---|---|
| 945,280 | A | * | 1/1910 | LindBerg | 248/242 |
| 3,602,472 | A | * | 8/1971 | Smyth-Tyrrell | 248/242 |
| 4,074,812 | A | * | 2/1978 | Skubic et al. | 211/192 |
| 4,146,140 | A | * | 3/1979 | Suter et al. | 211/190 |
| 4,151,917 | A | * | 5/1979 | Pugh | 211/88.01 |
| 4,351,244 | A | * | 9/1982 | Suttles | 108/107 |
| 4,498,714 | A | | 2/1985 | Wiese | |
| 4,537,316 | A | * | 8/1985 | Simon et al. | 211/133.3 |
| 4,550,893 | A | * | 11/1985 | Wiersema et al. | 248/224.8 |

(Continued)

OTHER PUBLICATIONS

Internet page from http://www.alibaba.conn/product-free/117845977/EASY_STAK_CIGARETTE_MERCHA . . . website with advertising for "Easy Stak Cigarette Merchandiser," published on or before Jun. 30, 2011.

(Continued)

*Primary Examiner* — Michael Safavi

(74) *Attorney, Agent, or Firm* — Buchanan Ingersoll & Rooney PC

(57) ABSTRACT

An article support, such as a shelf, is securely attachable at a plurality of locations along a generally vertical support or rail. The article support includes a support-engaging portion having one or more tabs, at least one of which is a locking tab having a forward-extending tooth that engages the vertical support, when the tab or tabs extend through slots in the support. Optionally, a biasing element urges the article away from the support to maintain secure engagement of the locking tab with the support. The resulting shelving system or article support system is resistant to accidental detachment of the article supports from the supports and permits relatively small adjustment intervals for the article supports along the supports.

19 Claims, 7 Drawing Sheets

(56) References Cited

U.S. PATENT DOCUMENTS

| | | | | | |
|---|---|---|---|---|---|
| 4,697,712 | A | * | 10/1987 | Valiulis | 211/187 |
| 4,809,855 | A | | 3/1989 | Bustos | |
| 5,004,201 | A | * | 4/1991 | Bessinger | 248/243 |
| 5,069,408 | A | * | 12/1991 | Bessinger | 248/250 |
| 5,199,579 | A | * | 4/1993 | Van Duyne | 211/90.04 |
| 5,265,740 | A | * | 11/1993 | Hodsden et al. | 211/187 |
| 5,484,196 | A | * | 1/1996 | Kim | 312/242 |
| 5,655,740 | A | * | 8/1997 | Lazarus | 248/243 |
| 6,138,583 | A | * | 10/2000 | Mahone et al. | 108/108 |
| 6,929,133 | B1 | | 8/2005 | Knapp et al. | |
| 7,334,692 | B2 | * | 2/2008 | Black | 211/187 |
| 7,641,057 | B2 | | 1/2010 | Mueller et al. | |
| 7,784,623 | B2 | | 8/2010 | Mueller et al. | |
| 7,931,156 | B2 | | 4/2011 | Hardy | |
| 8,123,185 | B2 | * | 2/2012 | Winig et al. | 248/250 |
| 2002/0027115 | A1 | * | 3/2002 | Gay et al. | 211/187 |
| 2004/0182976 | A1 | | 9/2004 | Valiulis et al. | |
| 2005/0127017 | A1 | * | 6/2005 | Kessel et al. | 211/187 |
| 2005/0199564 | A1 | | 9/2005 | Johnson et al. | |
| 2007/0023376 | A1 | * | 2/2007 | Black | 211/187 |
| 2008/0237163 | A1 | | 10/2008 | Smith | |
| 2011/0094975 | A1 | | 4/2011 | Hardy | |

OTHER PUBLICATIONS

Internet page from http://www.savantconstruction.com/articles1-16/TOBACCODISPLAY website with advertising for a cabinet display unit, published on or before Jun. 30, 2011.

* cited by examiner

SHELVING SYSTEM HAVING A SHELF WITH BIASING ELEMENTS TO RESIST INADVERTENT OR ACCIDENTAL DETACHMENT FROM A SUPPORT RAIL

FIELD OF THE INVENTION

The present invention relates generally to shelving and, more particularly, to brackets and other devices for attaching a shelf or other article support to a support rail or rails.

BACKGROUND OF THE INVENTION

Adjustable shelving for supporting or displaying articles in a height-adjustable manner typically includes one or two vertical rails with a plurality of vertically-spaced slots for receiving generally L-shaped tabs of a bracket (or a pair of spaced brackets) associated with a support shelf or the like. Such brackets are typically lifted and pulled away from the associated rail in order to disengage the tabs from the corresponding slots.

SUMMARY OF THE INVENTION

The present invention provides an article support, such as a shelf, hook or support rod, which is capable of being attached to a support rail in a manner that permits relatively small position adjustment intervals, and in a manner that is resistant to inadvertent or accidental detachment of the article support from the rail. For example, the article support may include a generally planar shelf with a pair of spaced bracket portions, each having a plurality of vertically-aligned and spaced-apart tabs for engaging correspondingly vertically-aligned spaced-apart slots of a pair of vertical support rails. At least one of the tabs comprises a locking tab with a tooth forming a hook or hook portion for engaging (from behind) a slot that is immediately below the slot through which the corresponding locking tab passes. Thus, when removing the shelf from the rails, the shelf is pushed rearwardly in the direction of the vertical support rails to disengage the tooth from the lower slot, and then the shelf is lifted and pulled to move the shelf brackets out of engagement with the support rails. To help secure or retain the shelf at the rails, the shelf may include one or more biasing elements, such as leaf springs, that bias the shelf in a direction away from the vertical support rails. In this manner, the tooth or hook portions of the locking tabs are urged into or maintained in engagement with respective slots of the vertical support rails, so that accidental bumping or jostling of the shelves will generally not disconnect or dislodge them from the support rails.

According to an aspect of the present invention, a shelving system for storage or display of articles includes a generally vertical support with a plurality of generally vertically-spaced slits, and an article-supporting element (such as a shelf, hook or rod) with a support-engaging portion for attaching the article-supporting element to the support. The support-engaging portion couples to the support at the slots formed in the support, and the support-engaging portion further includes a locking tab (such as a generally hook-shaped locking tab) that is inserted into the slots. The locking tab includes a rearward-extending portion, a downward-extending portion, and a tooth-like forward-projecting portion that is spaced from the rearward-extending portion. The forward-projecting portion of the locking tab is configured to engage the support at or near one of the slots in order to limit or prevent unintentional disengagement of the article support from the support. Optionally, the article support is part of a shelving system including one or more of the elongate support rails, and possibly including one or more additional article supports.

Optionally, the article-supporting element includes a biasing element that applies a force urging the article-supporting element away from the elongate support rail, which helps maintain engagement of the forward-projecting tooth portion of the locking tab with the support rail. For example, the biasing element may be a leaf spring that extends rearwardly from the article-supporting element to contact the support rail or a surface to which the support rail is attached.

Thus, the article support or support system of the present invention facilitates a secure attachment of the article support, such as a shelf, support hook or hanger rod, at a plurality of locations along an elongate support rail. A rail-engaging portion of the article support includes at least one locking tab having a hook or tooth portion that engages the support rail from behind, and may further include a spring or other biasing element to urge and maintain the hook or tooth portion of the locking tab into engagement with the support rail. This helps ensure that the article support maintains secure engagement with the support rail or rails, to protect against inadvertent or accidental separation of the article support from the rails. The tooth retention configuration allows for use of multiple, small or closely-spaced slots and tabs, which provides a finely adjustable shelving unit.

These and other objects, advantages, purposes and features of the present invention will become apparent upon review of the following specification in conjunction with the drawings.

DESCRIPTION OF THE PREFERRED EMBODIMENTS

Figure 2:
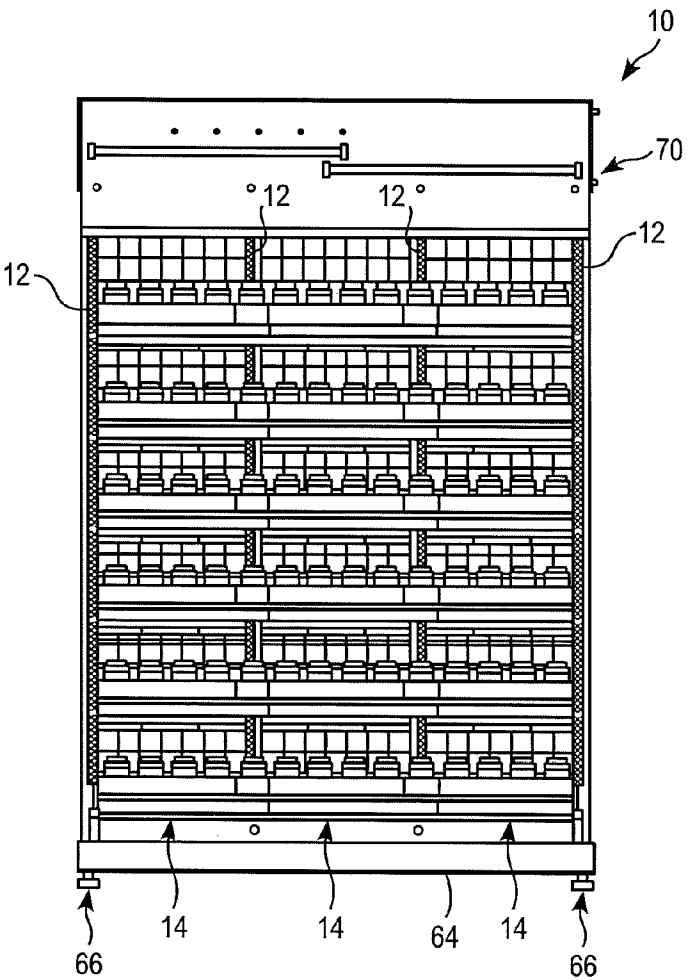
FIG. 2 is a front elevation of the shelving system of FIG. 1.
Figure 1:
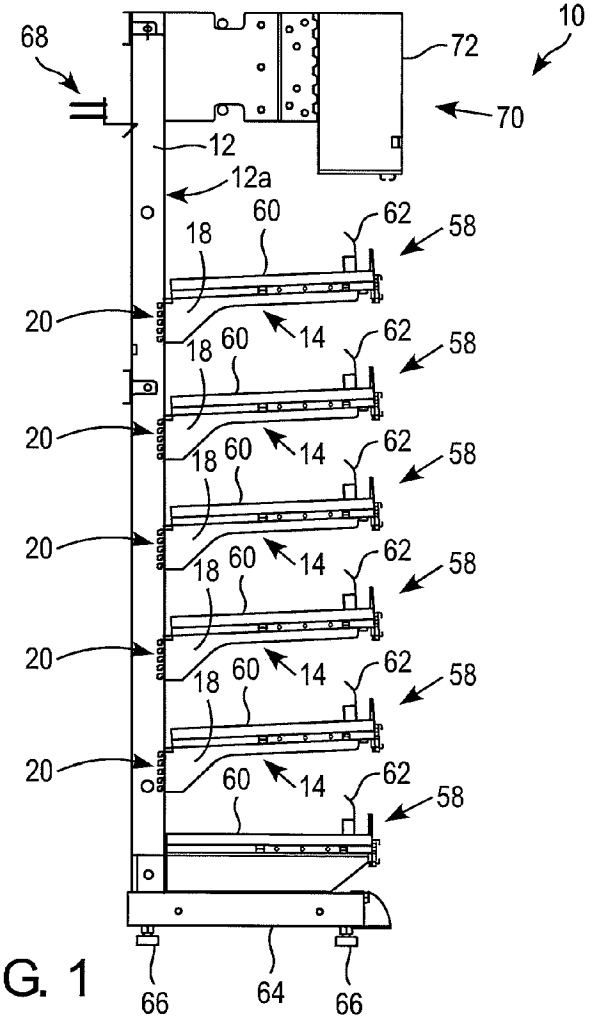
FIG. 1 is a side elevation of a shelving system in accordance with the present invention, including a plurality of article-supporting elements in the form of display shelves supported at generally vertical support rails.

Referring now to the drawings and the illustrative embodiments depicted therein, a shelf unit or assembly or system 10 includes one or more support rails 12 that support one or more article supports or shelves 14 (FIGS. 1 and 2). Article support or shelf 14 includes an article-supporting element or region 16 and a pair of spaced brackets or bracket portions 18 having respective rail-engaging portions 20 at a rear end of the shelf (FIGS. 5-9). Rail-engaging portion 20 includes a plurality of rear projections or tabs 22 that are arranged or configured for insertion into respective slots 24 of elongate support rail 12 (FIGS. 1, 4, 10 and 12), as discussed below. Shelf 14 further includes a pair of biasing elements in the form of leaf springs 26, such as shown in FIGS. 5-8. As will be described in more detail below, tabs 22 and leaf springs 26 cooperate to secure and retain shelf 14 along a pair of support rails 12 as part of shelving system 10, such as shown in FIGS. 1 and 2, as also discussed below. Such an arrangement substantially prevents accidental detachment of the shelf from the support rails, and may permit closer spacing intervals for positioning the shelves along the rails.

Figure 4:
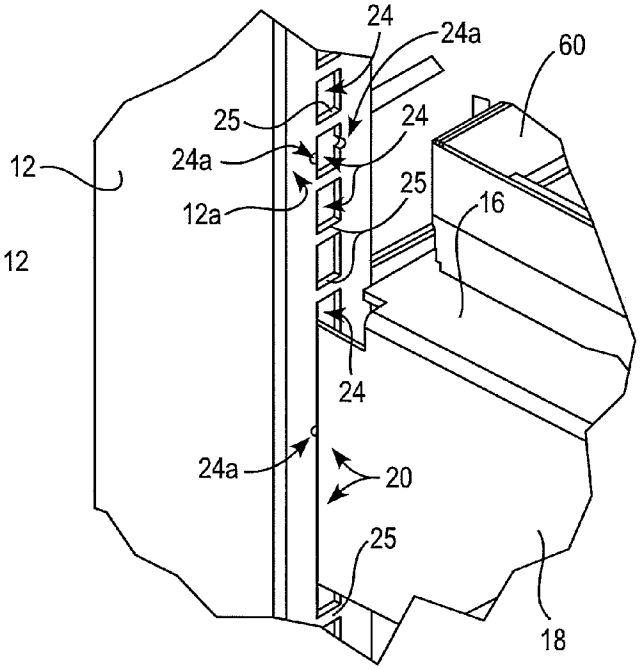
FIG. 4 is an enlarged perspective view of a portion of the shelving system of FIG. 1, with the rail-engaging portion of a shelf shown attached to a support rail.
Figure 3:
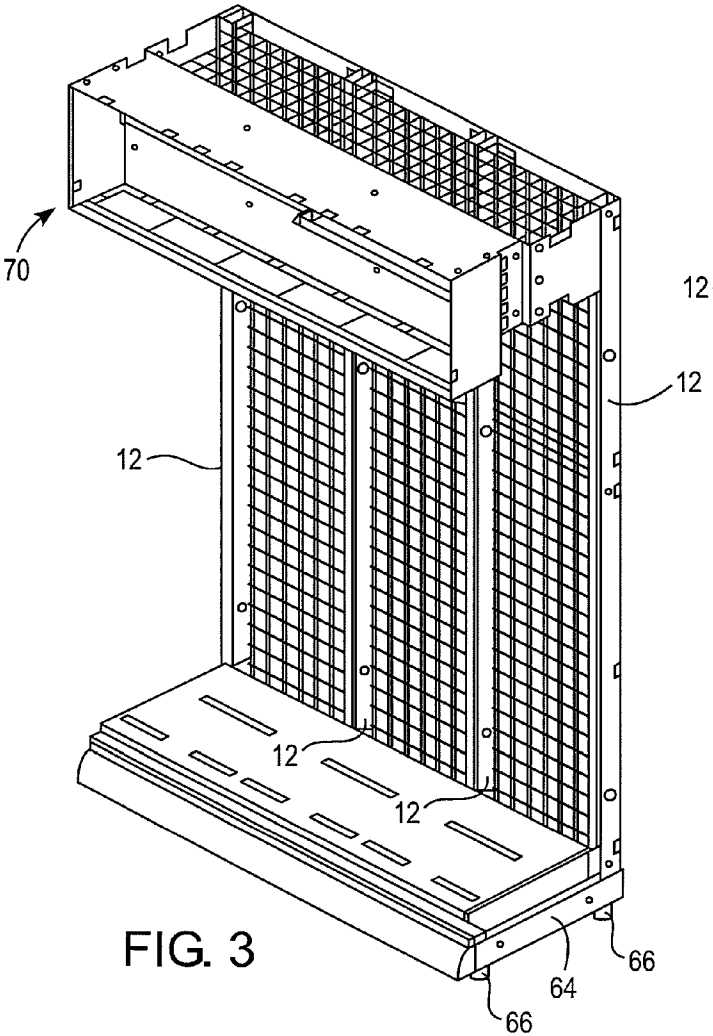
FIG. 3 is a perspective view of the shelving system of FIG. 1, with the shelves removed for clarity.
Figure 10:
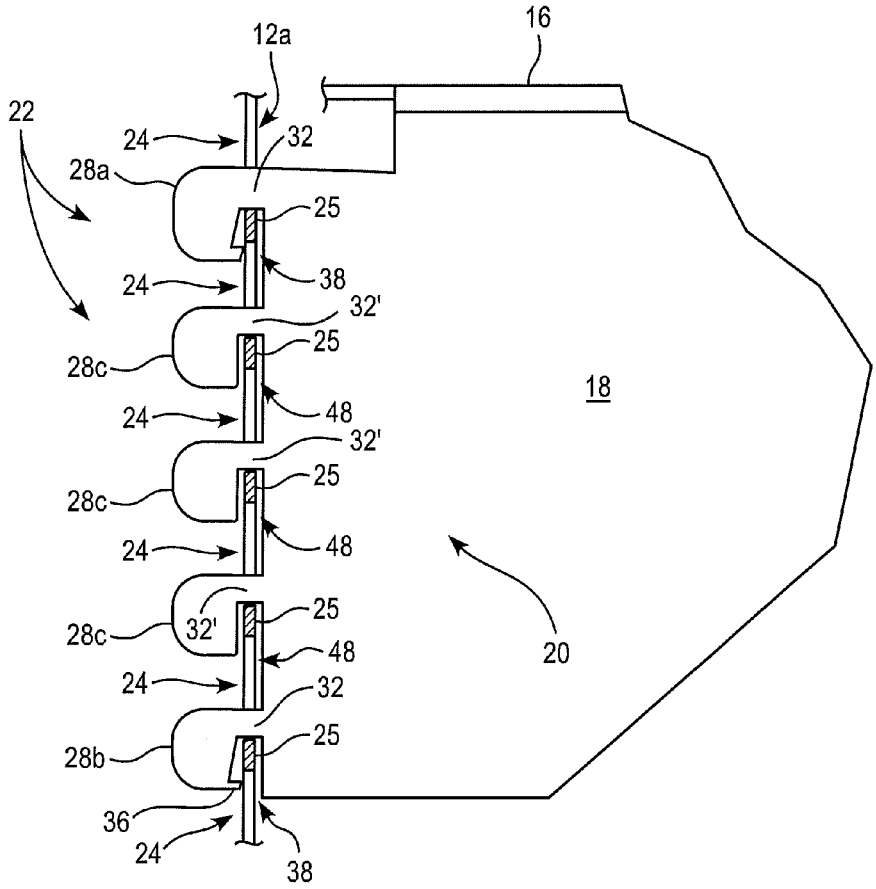
FIG. 10 is an enlarged side elevation of a rail-engaging portion of the display shelf of FIG. 5, shown with tabs engaging respective web portions of a rail.
Figure 12:
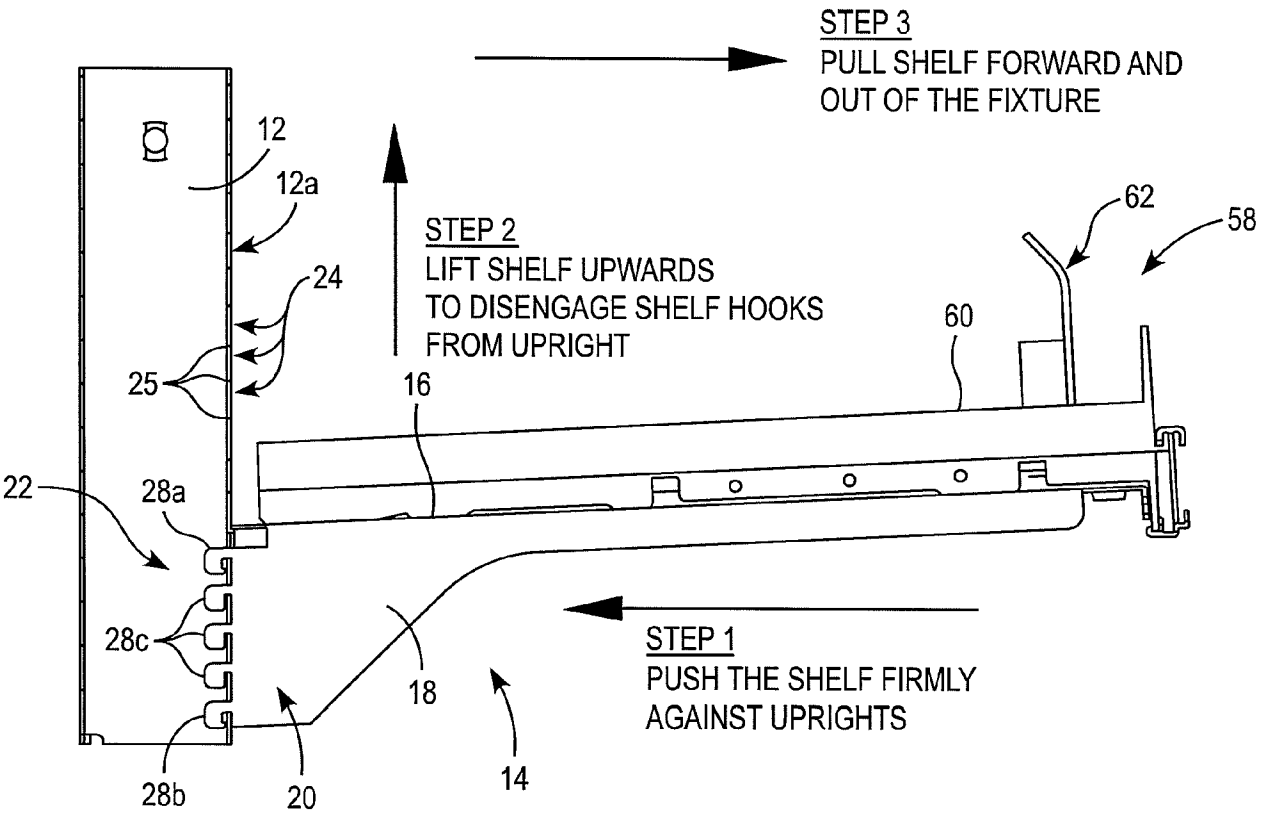
FIG. 12 is an enlarged side elevation of a portion of a display shelf, package tray unit and support rail from the shelving system of FIGS. 1 and 2, and illustrating three steps for removing the shelf from the support rail.

The shelf assembly 10 may include one or more generally vertical support rails 12, such as at least two spaced apart rails, or three or four or more rails such as shown in FIG. 3. Each support rail 12 includes a plurality of closely-spaced slots or apertures 24 formed through a forward wall 12*a* of the rail 12, with the upper and lower ends of each slot 24 defined by a web or web portion 25 of forward wall 12*a* (FIGS. 4, 10 and 12). The slots 24 are sized to receive the tabs 22 of shelf 14 therethrough, as discussed below. In the illustrated embodiment, every fifth slot 24 includes a semi-circular recess 24*a* on either side (FIG. 4) to provide an installer with a visual indication that corresponding slots of two or more spaced-apart rails 12 align with one another, to aid the installer with setting each shelf in a level arrangement. The shelf assembly 10 may include a pair of vertical support rails 12 for supporting opposite sides of a shelf 14, or may include multiple support rails 12 (as in FIGS. 1-3) for supporting two or more shelves 14 in a side-by-side manner (FIG. 2), or any other suitable or desirable configuration, while remaining within the spirit and scope of the present invention. Optionally, a single support rail 12 may receive the tabs of another bracket, such as a bracket of an article-supporting hook or hanger rod or projection, or a bracket for supporting a portion of a separate shelf or support platform or the like.

In the illustrated embodiment, shelf 14 comprises brackets 18 at opposite side portions of the supporting platform or region 16, and is mountable at or attachable at a pair of spaced-apart support rails 12. The shelf 14 includes a plurality of tabs 22 at each rail-engaging portion 20 of each bracket 18, including an upper locking tab 28*a* and a lower locking tab 28*b*, each of which is configured to limit or substantially preclude shelf 14 from being inadvertently or accidentally dislodged or disconnected from secure engagement with support rails 12 (FIGS. 4, 10 and 12). Tabs 22 further include three standard or non-locking tabs 28*c* that further support shelf 14, such as shown in FIGS. 10, 11C and 12.

Figure 11A:
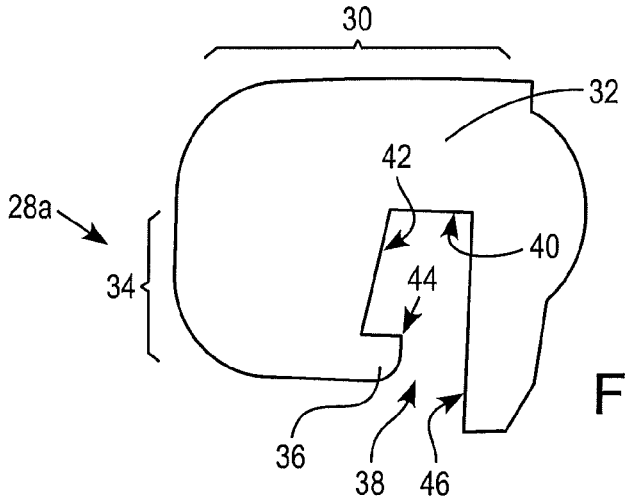
FIGS. 11A-11C are enlarged side elevations of an upper locking tab, lower locking tab, and non-locking tab, respectively, of the rail-engaging portion of the display shelf of FIG. 5.
Figure 11B:
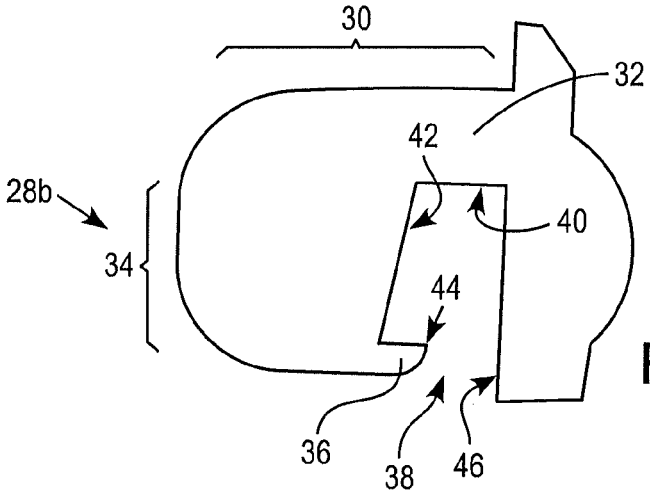

As best shown in FIGS. 11A and 11B, each of upper locking tab 28*a* and lower locking tab 28*b* includes a respective rearward-extending portion 30 including a neck region 32, a downward-extending portion 34, and a forward-projecting portion or tooth 36, so that the locking tabs 28*a*, 28*b* are generally hook-shaped. Each locking tab 28*a*, 28*b* defines a respective channel or opening 38 between (i) a lower surface 40 of neck region 32, (ii) a generally forward-facing surface 42 of downward-extending portion 34, (iii) an upper/forward-facing surface 44 of tooth 36, and (iv) a rearward-facing surface 46 of the bracket's rail-engaging portion 20. Channels 38 are sized and shaped to receive the respective webs or web portions 25 that are disposed between adjacent slots 24 of support rails 12 (FIGS. 4 and 10) when the bracket is supported at the rail or rails.

Figure 11C:
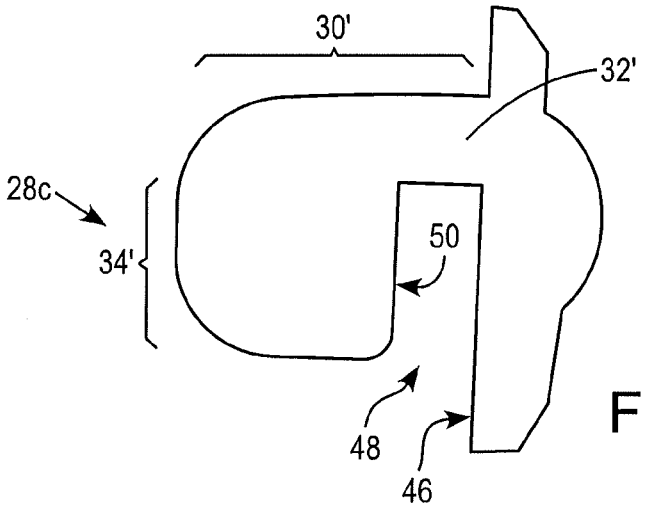

The standard or non-locking tabs 28*c* are generally L-shaped with rearward-extending portions 30' including neck regions 32', and downward-extending portions 34', but lack forward-projecting teeth (FIG. 11C). Standard tabs 28*c* define respective channels 48 between forward-facing surfaces 50 of downward-extending portions 34' and rearward-facing surfaces 46 of rail-engaging portion 20, for receiving web portions 25 of support rail 12 (FIG. 10), so that these standard tabs 28*c* may support some of the weight of shelf 14 and help to limit or prevent the shelf from being pulled directly away from support rail 12. Unlike locking tabs 28*a*, 28*b*, however, the standard tabs 28*c* do not substantially resist upward lifting movement of the shelf 14 relative to support rail 12. Although shown and described as having upper and lower locking tabs 28*a*, 28*b* with standard or non-locking tabs 28*c* disposed between the locking tabs, it is envisioned that any arrangement of tabs that includes at least one locking tab may be implemented at a shelf assembly or other support while remaining within the spirit and scope of the present invention.

In the illustrated embodiment, rail-engaging portion 20 has five total rear projections or tabs 22, the uppermost and lowermost of which are locking tabs 28*a*, 28*b* while the middle three are standard tabs 28*c*. However, it will be appreciated that a rail-engaging portion of a shelf or article support may include only a single locking tab, or substantially any number of tabs, any or all of which may be locking tabs. Thus, the locking tab or tabs may be positioned substantially anywhere among the tabs of the rail-engaging portion of an article support, without departing from the spirit and scope of the present invention.

When shelf 14 is attached or mounted at support rails 12, locking tabs 28*a*, 28*b* are inserted into respective slots 24 and shelf 14 is lowered slightly to receive and engage respective web portions 25 of support rail 12 into the channels 36 that are defined in part by the respective locking tabs. When arranged in this manner, the locking tabs' respective teeth 36 are disposed below the web portions 25 that define the lower ends of the slots 24 through which upper and lower locking tabs 28*a*, 28*b* extend (FIG. 10). Because the teeth 36 project further forward than the forward-facing surface 50 of standard tabs 28*c*, the teeth 36 may project at least slightly into the upper end portion of the slot 24 that is positioned directly below the slot through which the locking tab 28*a*, 28*b* is inserted. Thus, each tooth 36 engages or is in close proximity to a corresponding web portion 25 of elongate support rail 12, so that shelf 14 must be pushed rearwardly in the direction of support rail 12 to position the teeth 36 behind the corresponding web portion 25, so that the shelf can be lifted to disengage web portions 25 from channels 38 and 48.

The gap dimension of channel 48 of non-locking tabs 28*c* thus is slightly larger than the width of the web portions 25, while the gap dimension of the channels 38 formed between the teeth 36 and the rearward surface 46 of shelf bracket 18 is slightly greater than or generally equal to the width of the web portions 25, while being slightly less than the gap dimension of channels 48 of standard tabs 28*c*. Thus, teeth 36 of locking tabs 28*a*, 28*b* protrude into the lower slots (the slots below the respective slots through which the locking tabs are inserted) when the shelf is moved or urged or biased forwardly or away from the rails 12 (FIGS. 10 and 12), while forward-facing surfaces 50 of standard tabs 28*c* limit further forward movement of the shelf 14 relative to the rails 12. In this way, when the tabs 22 are inserted through slots 24 of support rails 12 to receive the webs 25 in the channels 38, 48, and when the shelf 14 is urged or biased forwardly away from rails 12, the teeth 36 of locking tabs 28*a*, 28*b* (or at least of upper locking tab 28*a* proximate the biasing element 26) protrude into the respective slots while the forward-facing surfaces 50 of standard tabs 28*c* engage the web portions 25 to limit further movement of shelf 14 away from rails 12, as discussed below. The different gap or channel width dimensions thus allow the teeth 36 of tabs 28*a*, 28*b* to protrude into respective lower slots when, after the tabs are fully seated at the web portions and rail, the shelf is moved or urged forwardly and away from rail 12, such as via manual movement of the shelf 14 by the person installing the shelf, or such as via a biasing element at the shelf or rails.

Optionally, and such as can be seen in FIGS. 10, 11A and 11B, neck region 32 and downward-extending portion 34 of upper locking tab 28*a* are slightly taller (i.e., have greater height dimensions as viewed in FIGS. 10, 11A and 11B) than the corresponding neck region 32 and downward-extending portion 34 of lower locking tab 28*b*. Similarly, tooth 36 of upper locking tab 28*a* is slightly taller or thicker than the tooth 36 of lower locking tab 28*b*. It will be appreciated that the additional material in these regions of upper locking tab 28*a* provides additional strength for this locking tab, as compared to lower locking tab 28*b*. This may be particularly advantageous such as when shelf 14 supports heavy loads at article-supporting region 16, since such loads will tend to apply significant tensile loads to upper locking tab 28*a*, and in particular, to the neck region 32 and downward-extending portion 34 and tooth 36 (the latter of which may experience significant shear loads or stresses when engaged with slot 24 and web 25). Such loads at article-supporting region 16 cause lower locking tabs 28*b* to experience comparatively low loads or stresses since these lower tabs would be pushed further into their respective slots 24. This is because the loads applied at the lower region of rail-engaging portion 20 will tend to urge the rail-engaging portion 20 (including rearward-facing surface 46) against forward wall 12*a* of support rail 12.

Figure 5:
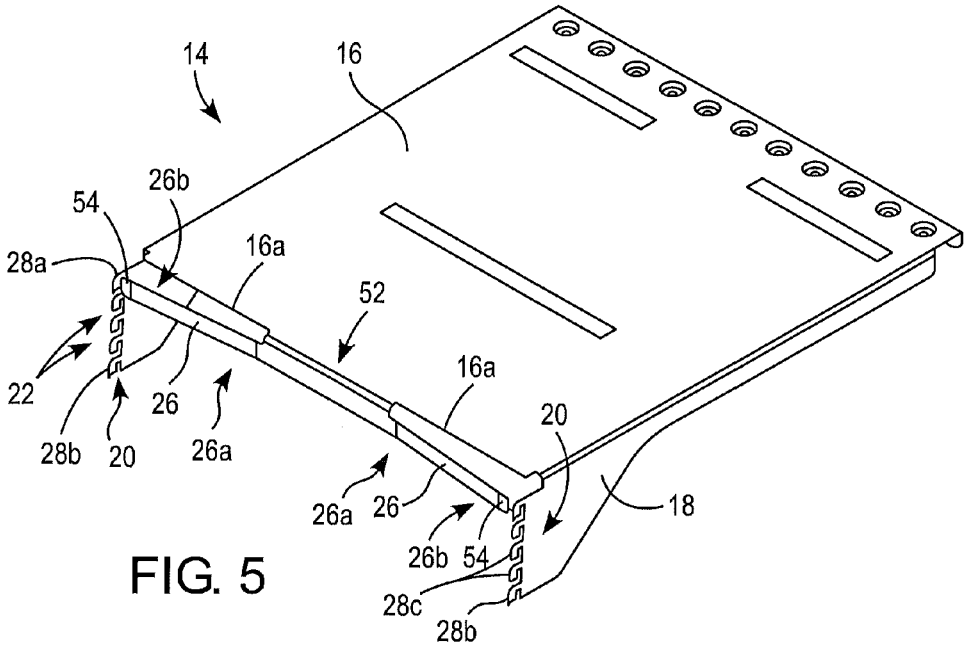
FIG. 5 is a rear perspective view of a display shelf from the shelving system of FIG. 1.
Figure 6:
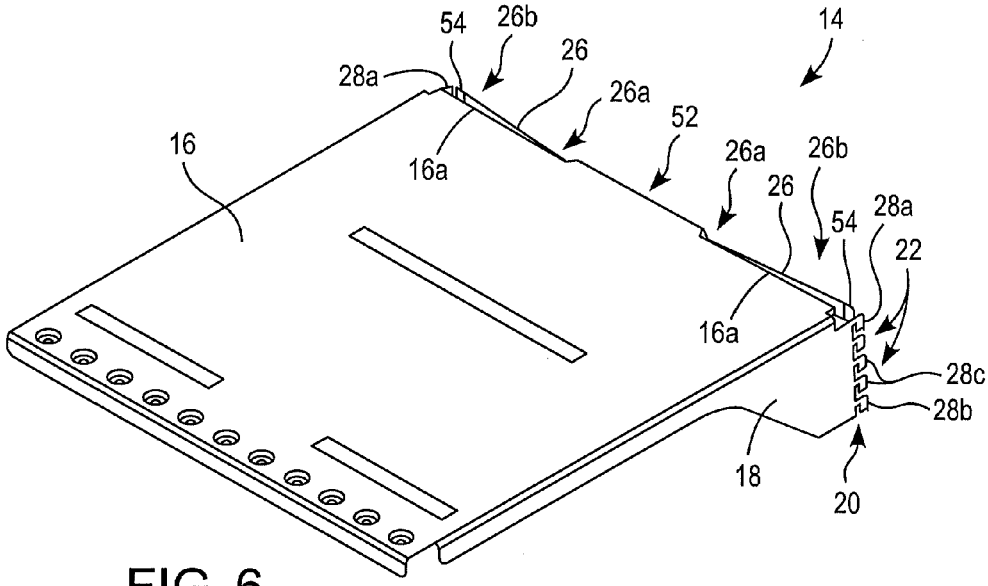
FIG. 6 is a front perspective view of the display shelf of FIG. 5.
Figure 7:
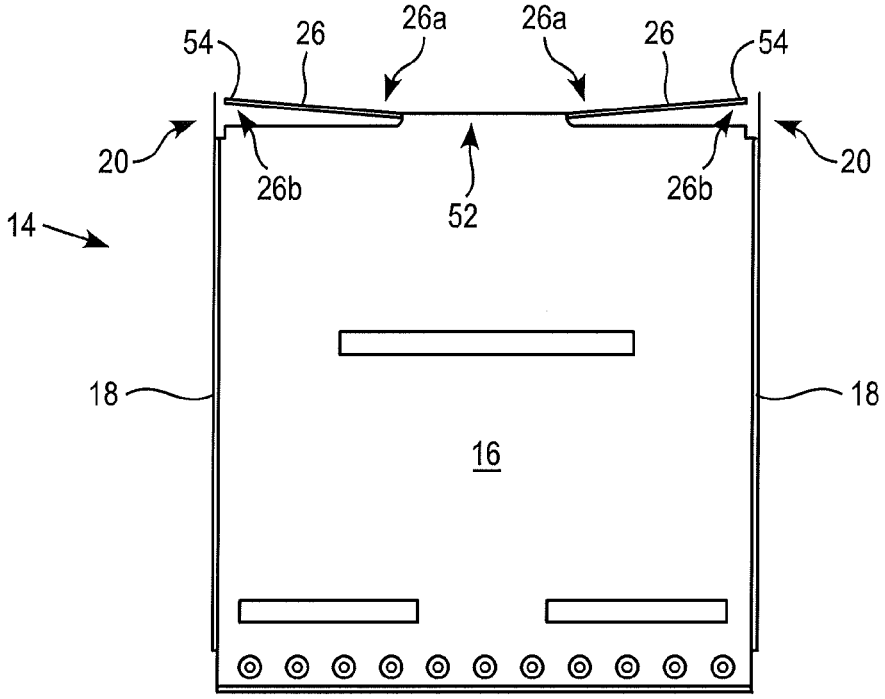
FIG. 7 is a top plan view of the display shelf of FIG. 5.

In the illustrated embodiment, the shelf 14 is biased or urged away from the rails via a biasing element or elements 26 formed or established or disposed at or near a rear edge portions 16*a* of article supporting region 16 of shelf 14. In the illustrated embodiment, biasing elements 26 extend from a central or base portion 52 at the rear edge portions 16*a* of article-supporting region 16 and proximate the upper locking tab 28*a* (FIGS. 5-8). Leaf springs 26 help maintain teeth 36 (and particularly the tooth of upper locking tab 28*a*) fully seated or engaged in a corresponding slot 24 so that an upward lifting force applied to shelf 14 generally will not cause tabs 22 of rail-engaging portion 20 to disengage from support rails 12. Leaf springs 26 accomplish this by biasing shelf 14 in a direction generally away from support rails 12. In the illustrated embodiment, each leaf spring 26 includes a respective proximal end portion 26*a* that is at or coupled to base portion 52 of article-supporting region 16. Each leaf spring 26 further includes a distal end portion 26*b* that forms a contact region or surface 54 for engaging a corresponding rail 12 (e.g., at forward wall 12*a*) or other support surface. As best shown in FIGS. 5 and 7, each leaf spring 26 is generally in the form of a cantilever tab or beam that extends laterally outwardly away from central mounting portion 52 of article-supporting region 16. However, each leaf spring 26 also extends or projects somewhat rearwardly, such that in the spring's relaxed state, its contact region or surface 54 is positioned rearwardly of both central mounting portion 52 and the spring's own proximal end portion 26*a*, such as shown in FIG. 7.

Contact region or surface 54 at distal end portion 26*b* of leaf spring 26 contacts a wall or other mounting surface to which support rails 12 are attached, or may contact the support rail 12 such as at forward wall 12*a*. When tabs 22 are engaged with respective slots 24 of support rails 12, leaf springs 26 are biased forwardly relative to article-supporting region 16 of the shelf 14, and thus apply a biasing force to the shelf in a direction away from support rail 12 and/or the surface(s) to which the rail or rails are attached. This biasing force maintains the engagement of tooth 36 of upper locking tab 28*a* with the slot 24 in particular, so that removing shelf 14 from support rail 12 requires first pushing shelf 14 rearwardly toward support rail 12 (against the biasing force of leaf spring 26, such as referenced as "STEP 1" in FIG. 12) to disengage locking teeth 36 from their respective slots 24, after which shelf 14 may be lifted upwards ("STEP 2" of FIG. 12) to disengage web portions 25 from their respective channels 38, 48, and then the shelf 14 may be pulled forwardly ("STEP 3" of FIG. 12) to fully disengage tabs 22 from support rail 12, such as shown in FIG. 12.

It will be appreciated that the biasing force of each leaf spring 26 may be adjusted according to the angle at which each leaf spring 26 extends rearwardly from central mounting portion 52, or by adjusting the shape and/or hardness and/or spring rate and/or the like of each spring. Optionally, another biasing element (such as a coil spring or additional leaf spring), could be placed between the rear edge portions 16*a* of article-supporting region 16 and each leaf spring 26. Optionally, and instead of leaf springs 26, it will be appreciated that substantially any biasing element, such as coil springs, resilient/compressible members or the like, may be positioned at a rear portion of shelf 14 or a forward portion of the support rail or support wall, for applying a biasing force between the shelf and the rail or wall to urge the shelf away from its respective support rail or rails or wall, when the shelf is supported at the rails, without departing from the spirit and scope of the present invention.

Thus, locking tabs 28*a*, 28*b* and leaf spring 26 cooperate to limit or substantially prevent inadvertent or accidental removal of shelf 14 from its support rails 12, since the sequential combination of forces needed to remove the shelf (i.e., inward/rearward, upward, and outward/forward forces applied in sequence) would generally occur only when an installer or user intends to remove or adjust the shelving. For example, if shelf 14 were accidentally bumped or moved upwardly, tooth 36 of lower locking tab 28*b* would more fully insert into its corresponding slot 24 and engage the lower surface of the web portion 25 at the upper end of the slot 24 (if not already so-engaged), so that both teeth 36 would resist any upward movement of the shelf, which is necessary to separate the shelf from the support rail. Similarly, an inadvertent bump or force in an inward direction (e.g., as in "STEP 1" of FIG. 12) may briefly disengage the teeth 36 from their slots 24, against the biasing force of leaf springs 26, but such an accidental inward force would not typically be followed by an accidental force in the upward direction (e.g., as in "STEP 2" of FIG. 12). Also, after any such brief or accidental application of inward force, leaf springs 26 will tend to urge shelf 14 away from support rail 12 to re-engage one or both teeth 36 into their corresponding slots 24, thus re-securing or maintaining securement of shelf 14 at support rail 12.

It will be appreciated that the ability of locking tabs 28*a*, 28*b* to securely engage support rails 12 allows the slots 24 to be spaced more closely together than is common or typical in other shelving systems. For example, and with reference to FIG. 4, each web portion 25 may have a height or thickness of only about $1/8^{th}$ inch and each slot 24 may be about $3/8^{ths}$ inch in height, to create about ½ inch slot spacing (i.e. shelf adjustment) intervals. Optionally, each slot 24 may have sufficient height to receive any of the tabs 22 (including locking tabs 28*a*, 28*b*) plus the tooth 36 of one of the locking tabs 28*a*, 28*b*, such as shown in FIGS. 10 and 12. In addition, each slot 24 may have sufficient width, as best shown in FIG. 4, to receive the tabs of a single shelf bracket or to receive tabs of two side-by-side shelf brackets, so that a single rail 12 may support two adjacent shelves 14, with the tabs 22 of adjacent shelves positioned side-by-side in respective slots 24.

Figure 8:
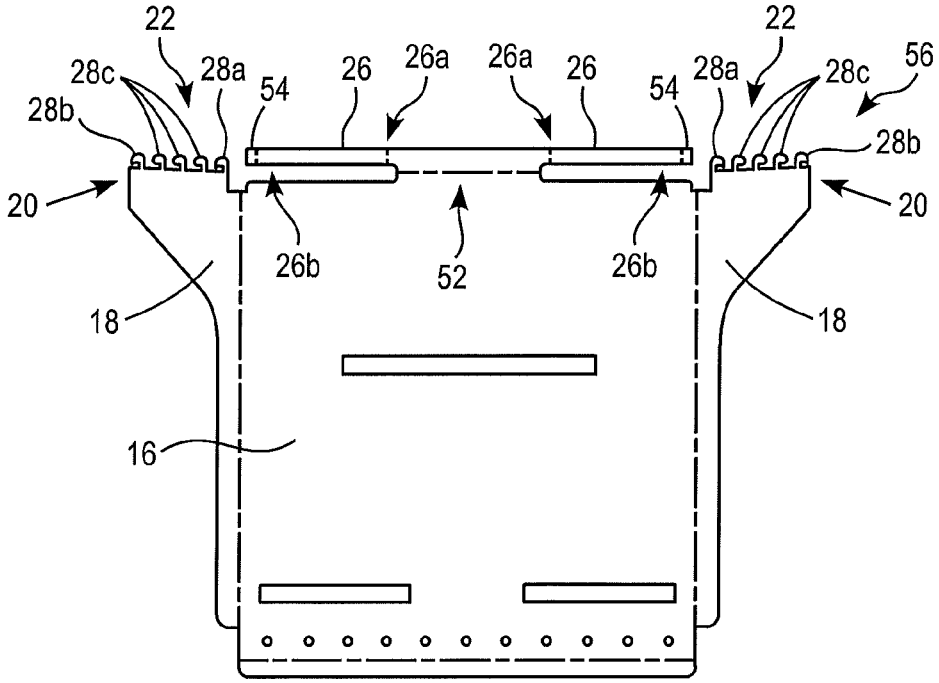
FIG. 8 is a top plan view of a cut sheet metal blank for use in forming the display shelf of FIG. 5.
Figure 9:
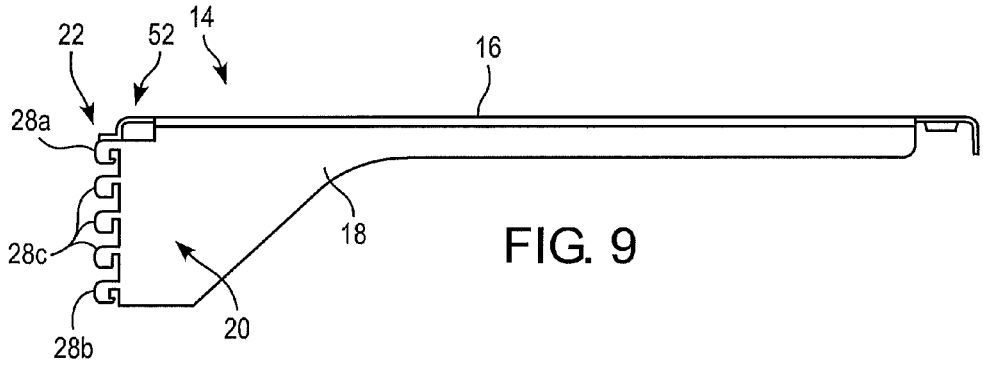
FIG. 9 is a side elevation of the display shelf of FIG. 5.

Shelf 14 may comprise any suitable material, such as a metallic material or steel or lightweight alloy or composite or substantially any material that is sufficiently strong and durable. For example, in the illustrated embodiment, shelf 14 may be unitarily formed from a single piece or sheet of planar sheet metal that is initially cut using any desired method (such as die-cut, laser-cut, etc.) to form a blank 56 (FIG. 8). Blank 56 is then bent, such as in one or more stamping operations, to create the shelf's final shape as shown in FIGS. 5 and 6. The formed shelf may be finished with substantially any desired material, such as by painting, powder-coating, polishing or the like.

Accordingly, a plurality of shelves 14 may be positioned along a pair of support rails 12 to form shelving system 10, such as in a retail display area, storage area, or the like (FIGS. 1 and 2). In the illustrated embodiment of FIGS. 1 and 2, each shelf 14 supports a corresponding package tray unit 58 having a tray portion 60 and a pusher shoe 62 for urging articles toward the front of package tray unit 58 to facilitate dispensing or removal of the articles, as is known in the art (and such as by utilizing aspects of the shelf systems described in U.S. Pat. No. 7,950,538, which is hereby incorporated herein by reference in its entirety). In addition, shelving system 10 may include a base 64 (FIGS. 1-3) to which elongate support rails 12 are attached and supported in a vertical arrangement. Base 64 includes a plurality of support feet 66 that support shelving system 10 on a floor or other support surface. Support feet 66 may be adjustable to level the system and/or to prevent wobble, such as when the system is supported on an uneven floor surface.

Optionally, and as shown in FIG. 1, one or more stabilizers or couplers 68 may be provided at an upper end portion of the elongate support rails 12 for attaching the rails to a support surface, such as a wall or rail or the like, or to the support rails of another shelving system such as in a back-to-back arrangement of shelving units or systems. Shelving system 10 may further include a top display support 70 that can display advertisements or information, such as advertisements pertaining to products that are supported on the package tray units 58. Display support 70 may be electrified to provide backlighting for a display surface 72 (FIG. 1), or to provide lighting for at least the uppermost shelves 14 and tray units 58, for example.

Therefore, the present invention provides a shelving system that is resistant to accidental or inadvertent separation of shelves from one or more vertical supports or support rails, and which is sufficiently strong and secure to permit the shelves to be adjusted along the support rails in relatively small intervals. Although the article support that is primarily shown and described herein comprises a shelf having a pair of brackets for attachment to a corresponding pair of elongate support rails, it is envisioned that the principles of the present invention may be practiced in connection with substantially any article support. For example, a support hook or hanger rod may incorporate a rail-engaging portion similar to the rail-engaging portion 20 of shelf 14, as described above. Moreover, substantially any article support may include a single rail-engaging portion for attaching the article support to a single vertical support or elongate support rail, or may include three or more rail-engaging portions for engaging three or more corresponding support rails, such as to increase the stability and/or load-bearing capacity of the article support.

In addition, it is envisioned that the elongate support rail or rails may be positioned in a non-vertical arrangement, such as in an angled or horizontal orientation, without departing from the spirit and scope of the present invention. Thus, it will be appreciated that the terms "upper", "upward", "lower", "downward", "rearward", "forward", etc., as used herein, are relative terms used for explaining directions as would generally be understood for use in connection with a conventionally-mounted horizontal shelf, and are not intended to be limiting in any way.

Changes and modifications to the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property is claimed are defined as follows:

1. A shelving system for storage or display of articles, said shelving system comprising: a generally vertical support defining a plurality of generally vertically-spaced slots; a shelf including an article-supporting surface and a support-engaging portion for releasably attaching said shelf to said support at said slots; said support-engaging portion of said shelf including at least one locking tab configured for insertion into said slots of said support, said at least one locking tab comprising a rearward projection having a distal end portion, a downward projection portion extending downwardly from said distal end portion, and a tooth extending forwardly from said downward projection portion; wherein said locking tab is received in a first slot and said tooth of said locking tab is configured to engage said support at or near a second slot for securing said shelf against unintentional disengagement from said support; and said article-supporting surface including a pair of biasing elements extending rearwardly from a rear edge thereof configured to urge said shelf in a direction away from said support, to thereby maintain engagement of said tooth with said support; wherein said support comprises a pair of elongate support rails and said support-engaging portion of said shelf comprises a pair of said support-engaging portions for engaging respective ones of said elongate support rails.

2. The shelving system of claim 1, wherein support-engaging portion comprises a plurality of tabs for simultaneous engagement with corresponding ones of said slots in said support, at least one of said plurality of tabs comprising said locking tab.

3. The shelving system of claim 2, wherein said slots are sufficiently large to simultaneously receive a portion of a first one of said tabs and said tooth of said at least one locking tab.

4. The shelving system of claim 1, wherein each of said biasing elements comprises a leaf spring, each operable to apply a force against a respective elongate support rail or against a support surface to which said elongate support rails are coupled.

5. The shelving system of claim 1, wherein the shelf is formed from a single sheet of metallic material.

6. The shelving system of claim 1, wherein said vertically-spaced slots are spaced by not more than about ⅛ inch.

7. The shelving system of claim 1, wherein said vertically-spaced slots are sufficiently wide to receive two of said locking tabs, of adjacent shelves, in side-by-side arrangement.

8. A shelving system for storage or display of articles, said shelving system comprising: a support arranged generally vertically and defining a plurality of generally vertically-spaced slots; a shelf including an article-supporting surface, a support-engaging portion for releasably attaching said shelf to said support at said slots, and a biasing element; said support-engaging portion of said shelf comprising a plurality of tabs configured for insertion into respective ones of said slots in said support, said tabs including at least one locking tab comprising a rearward projection having a distal end portion, a downward projection extending downwardly from said distal end portion, and a tooth extending forwardly from said downward projection; wherein said tooth of said locking tab is configured to engage said support at or near one of said slots for securing said shelf against unintentional disengagement from said support; and wherein said biasing element extends rearwardly from a rear edge of the article-supporting surface and is configured to urge said shelf in a direction away from said support to thereby maintain engagement of said tooth of said locking tab with said support.

9. The shelving system of claim 8, wherein said biasing element comprises a leaf spring operable to apply a force against said support or against a support surface to which said support is coupled.

10. The shelving system of claim 8, wherein said support comprises a pair of spaced supports and wherein said shelf comprises a pair of said support-engaging portions for engaging respective ones of said supports.

11. The shelving system of claim 10, comprising a pair of biasing elements wherein each biasing element is a leaf spring extending rearwardly from said rear edge of the article-supporting surface to engage and apply a force against (i) a support surface to which said support is coupled or (ii) respective ones of said supports.

12. The shelving system of claim 8, wherein said support comprises an elongate support rail.

13. The shelving system of claim 1, wherein each biasing element is a leaf spring that extends rearwardly from said rear edge of the article-supporting surface to engage and apply a force against (i) a support surface to which said support is coupled or (ii) respective ones of the elongate support rails of said support.

14. The shelving system of claim 13, wherein each leaf spring extends laterally outwardly from a central mounting portion at the rear edge of the article-supporting surface.

15. The shelving system of claim 11, wherein each leaf spring extends laterally outwardly from a central mounting portion at the rear edge of the article-supporting surface.

16. The shelving system of claim 1, wherein the support comprises four elongate rails and the shelving system includes: a base to which the elongate support rails are attached and supported in a vertical arrangement wherein the base includes a plurality of support feet which are adjustable so as to level the shelving system; a top display support configured to display an advertisement wherein the top display support includes backlight operable to light the uppermost shelves of the shelving system and/or a display surface of the top display support; and a stabilizer at an upper end portion of each of the elongate support rails wherein each stabilizer is operable to attach a respective elongate support rail to a support surface or a support rail of an adjacent shelving system disposed in a back-to-back arrangement.

17. The shelving system of claim 1, wherein every fifth slot of the vertically-spaced slots includes a semi-circular recess on either side thereof, and each support-engaging portion comprises five tabs for simultaneous engagement with corresponding ones of said slots in said elongate support rails wherein an uppermost tab and a lowermost tap of said five tabs comprises said locking tab.

18. The shelving system of claim 1, wherein each support-engaging portion comprises a plurality of tabs for simultaneous engagement with corresponding ones of said slots in said elongate support rails wherein an uppermost tab of said plurality of tabs comprises said locking tab, and each biasing element is a cantilever tab extending laterally outward from a central mounting portion at the rear edge of the article-supporting surface wherein the cantilever tabs are proximate the uppermost tab and a distal end of each cantilever tab forms a contact surface configured to engage a respective elongate support rail or support surface to which the elongate support rails are attached.

19. A shelf of a shelving system for storage or display of articles, said shelf comprising an article-supporting surface and a pair of support-engaging portions configured to releasably attach said shelf to vertically-spaced slots of a pair of respective elongate support rails; said pair of support-engaging portions of said shelf including at least one locking tab configured to be inserted into said slots of said pair of respective elongate support rails, said at least one locking tab comprising a rearward projection having a distal end portion, a downward projection portion extending downwardly from said distal end portion, and a tooth extending forwardly from said downward projection portion; wherein said locking tab is configured to be received in a first slot of a respective elongate support rail and said tooth of said locking tab is configured to engage said elongate support rail at or near a second slot thereof so as to secure said shelf against unintentional disengagement from said pair of elongate support rails; and said article-supporting surface including a pair of biasing elements extending rearwardly from a rear edge thereof configured to urge said shelf in a direction away from said pair of elongate support rails so as to maintain engagement of said tooth with said respective elongate support rail.

* * * * *